United States Patent [19]

Vaubel et al.

[11] 4,421,156

[45] Dec. 20, 1983

[54] PROCESS FOR THE OPTIMIZED HEAT TRANSFER FROM CARRIERS OF REVERSIBLE, HETEROGENEOUS EVAPORATION PROCESSES FOR THE PURPOSE OF GENERATING HEAT OR COLD AND APPARATUS FOR CARRYING OUT THE PROCESS

[75] Inventors: Gert Vaubel, Paderborn-Schloss Neuhaus; Rolf Rathert, Bielefeld; Alfred Ritter, Mulheim, all of Fed. Rep. of Germany

[73] Assignee: Studiengesellschaft Kohle mbH, Mulheim, Fed. Rep. of Germany

[21] Appl. No.: 329,797

[22] Filed: Dec. 11, 1981

[30] Foreign Application Priority Data

Dec. 17, 1980 [DE] Fed. Rep. of Germany ..... 3047632

[51] Int. Cl.[3] ..... F28D 21/00

[52] U.S. Cl. ..... 165/1; 165/32; 165/104.12; 165/104.13; 165/104.14

[58] Field of Search ..... 165/104.14, 104.12, 165/32, 1, 104.4, DIG. 17, 104.13

[56] References Cited

U.S. PATENT DOCUMENTS

| | | | |
|---|---|---|---|
| Re. 18,665 | 11/1932 | Munters | 62/333 X |
| 1,614,185 | 1/1927 | Canon et al. | 165/104.21 X |
| 2,044,951 | 6/1936 | Munters | 165/104.21 X |
| 4,039,023 | 8/1977 | McClaine | 165/104.12 X |
| 4,044,819 | 8/1977 | Cottingham | 165/104.12 |
| 4,161,211 | 7/1979 | Duffy et al. | 165/104.12 X |
| 4,300,626 | 11/1981 | Busse et al. | 165/104.26 |

*Primary Examiner*—Albert W. Davis, Jr.
*Attorney, Agent, or Firm*—Sprung, Horn, Kramer & Woods

[57] ABSTRACT

A process for the optimized heat transfer from carriers of reversible, heterogeneous evaporation processes for the purpose of generating heat and cold by means of the principle of the heat pipe is described, which comprises arranging the carrier of the reversible, heterogeneous evaporation process in the interior of a heat pipe. Moreover, this application describes the apparatus for carrying out the process in which a heat pipe is provided with a heat source at the bottom and with a heat sink at the top and exhibits a carrier of a reversible, heterogeneous evaporation process and a feed line and discharge line for the gas of the reversible, heterogeneous evaporation process.

14 Claims, 7 Drawing Figures

PROCESS FOR THE OPTIMIZED HEAT TRANSFER FROM CARRIERS OF REVERSIBLE, HETEROGENEOUS EVAPORATION PROCESSES FOR THE PURPOSE OF GENERATING HEAT OR COLD AND APPARATUS FOR CARRYING OUT THE PROCESS

BACKGROUND OF THE INVENTION

This invention relates to a process for the optimized heat transfer from carriers of reversible, heterogeneous evaporation phenomena for the purpose of heat generation or refrigeration, this process utilizing the principle of the heat pipe. Heat pipes are known from U.S. Pat. No. 2,350,348 and from the puplication by P. D. Dunn and D. A. Reay, Heat Pipes, Pergamon Press, 1976. Due to their outstanding heat transport performance, they are accepted in industry to an increasing extent. Particularly simple to manufacture are heat pipes which operate according to the thermosiphon principle. However, it is a requirement hereof that the evaporation zone of the heat pipe is arranged beneath the condensation zone.

Reversible, heterogeneous evaporation is a generally known principle and may proceed with or without chemical change. For example, the gas absorption on carriers such as activated charcoal is of a purely physical nature. Examples of reversible, heterogeneous evaporation phenomena with chemical conversion are the formation and decomposition of metal hydrides and ammoniated salts like calcium chloride ammoniacate. Independently of whether these processes are of a chemical or physical nature, the evaporation or ejection process is always endothermal while the oppositely directed absorption process proceeds exothermally.

The use of reversible, heterogeneous evaporation processes on a carrier always suffered in the past from the substantial disadvantage that the heat transfer from the carrier to its environment proceeds only very slowly and with very low efficiency because the carrier materials generally exhibit poor heat conductivity. This results in undesirably long cycle times when operating periodically operated apparatus such as refrigerating machines or heat pumps as well as in correspondingly largely and voluminously designed apparatus because the heat transport performances or efficiencies required can only then be achieved.

In U.S. Patent application Ser. No. 268,970, filed June 1, 1981, a process and an apparatus for the energy-saving recovery of useful or available heat from the environment or from waste heat have been proposed. In this process, there is utilized, for example, the heat reaction taking place as a metal hydride is formed and decomposed. In a preferred embodiment, the reversible heat exchangers are replaced by heat pipes. In the apparatus described in this patent application, the upper or lower end of a heat pipe extends into the reservoir containing the metal hydride and carriers off the heat or cold generated by the reaction via the heat pipe. Heat transfer from the metal hydride as the carrier to the heat pipe takes place only in a relatively small region and, consequently, is only very slow and incomplete.

SUMMARY OF THE INVENTION

It has now been found that the process for the heat transfer from carriers of reversible heterogeneous evaporation phenomena or processes for the purpose of generating heat or cold by means of the principle of the heat pipe can be optimized by the fact that the carrier of the reversible heterogeneous evaporation process is arranged in the interior of a heat pipe. By this measure, the effects of reversible evaporation processes on carriers are transferred in surprisingly simple and efficient manner by the principle of the heat pipe.

Thus, the apparatus according to the invention for carrying out the process consists of a heat pipe which is connected at the bottom to a heat source and, at the top, to a heat sink which contains a low-boiling liquid and a carrier of a reversible, heterogeneous evaporation process and exhibits a feed pipe and discharge pipe, respectively, for the gas of the reversible, heterogeneous evaporation process.

A plurality of fundamental routes suggest themselves for carrying out the process according to the invention. For example, two heat pipes containing the carrier of the reversible, heterogeneous evaporation process in the interior of the heat pipe may be connected in such a manner that the two carriers are interconnected through a gas line and a pump and both heat pipes may be turned together through 180 degrees in such a manner that, in one heat pipe, the carrier is at the top and, in the other heat pipe, the carrier is at the bottom. One certain disadvantage of this solution to the problem is the fact that, on principle, the whole arrangement must be constructed to be turnable through 180 degrees, which results in a certain expense of technology and energy.

A further possibility is that the position of the carrier of the reversible heterogeneous evaporation within the heat pipe can be changed in a controlled manner from the outside. This may, for example, be effected by the fact that the carrier of the reversible, heterogeneous evaporation process contains an iron core and may be displaced within the heat pipe from the outside by means of a magnet.

A preferred embodiment consists of two superposed heat pipes which are separated from each other by the carriers of the reversible, heterogeneous evaporation process.

A further embodiment utilizes the principle of the absorption heat pump so that the mechanically compressing pump may be dispensed with.

Of course, the rate of heat transfer increases if the carrier material is shaped geometrically in such a manner that as large a surface of contact as is possible is available for the low-boiling liquid.

Particularly simple from the constructional point of view and inexpensive from the mechanical point of view are those apparatus in which the carrier of the reversible, heterogeneous evaporation process, the particular gas used and the liquid and vapor of the particular low-boiling liquid used are compatible with one another. In this case, a direct contact of the carrier surface with the low-boiling liquid or its vapor is capable of taking place, which substantially intensifies the heat transfer, especially if the carrier is shaped geometrically in such a manner that it exhibits a large surface area.

Since both the vapor of the low-boiling liquid and the gas of the reversible, heterogeneous evaporation are present in the gaseous phase in this embodiment, the feed line to the interior of the heat pipe must be provided with a pressure-proof semipermeable membrane which separates the gas from the vapor of the low-boiling liquid thereby preventing the vapor from excaping from the heat pipe.

A further possibility is to jacket or envelop the carrier of the reversible, heterogeneous evaporation process thereby separating it from the low-boiling liquid and/or its vapor. This prevents mixing of the vapor with the gas so that separation by a semipermeable membrane is indeed unnecessary.

In case of the embodiment where two heat pipes are arranged in superposition, it is possible on principle to fill the upper and lower heat pipes with different low-boiling liquids thereby optimizing the conditions in the two heat pipes. For example, if the heat source supplies energy of relatively low temperature while, on the other hand, relatively high temperatures are generated in the carrier of the reversible, heterogeneous evaporation, the boiling points of the two liquids in the upper and lower heat pipes should be selected such that they are adapted correspondingly to each other. It is possible in this manner expecially in case of using metal hydrides to transform energy of low temperature into energy of high temperature and make it available as useful heat.

To carry out the process according to the invention, all carries of reversible, hetereogeneous evaporation processes may be used on principle. The process is preferably useful for the energy-saving recovery of useful or available heat from the environment or from waste heat by means of metal hydrides and hydrogen according to German Patent Application P 30 20 565.3 as well as its modification as absorption heat pump.

Some apparatus which are useful for carrying out the process according to the invention are illustrated hereinafter in greater detail with reference to the drawings wherein:

DETAILED DESCRIPTION OF THE PREFERRED EMBODIMENTS

Figure 1:
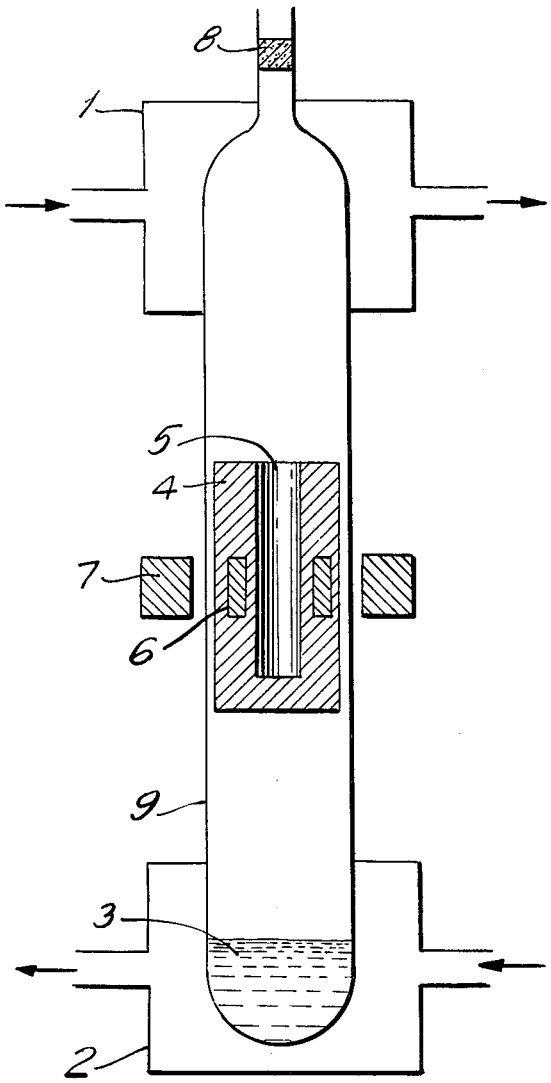
FIG. 1 shows a schematic representation of one embodiment of an apparatus for carrying out the process of the present invention.

FIG. 1 shows a heat pipe in which the position of the carrier of the reversible, heterogeneous evaporation process within the heat pipe may be changed by control from the outside.

In FIG. 1, the heat pipe is a reaction vessel which includes a wall 9 consisting of a nonmagnetic material. The top of the heat pipe is connected to a heat sink 1 and the bottom of the heat pipe is connected to a heat source 2. Within the heat pipe is the condensate 3 of a low boiling liquid and a compressed carrier 4 such as, for example, a molding consisting of a metal hydride. The carrier 4 has a central bore 5 and an iron ring 6 inserted therein. The carrier is capable of being displaced by a magnet 7 which is disposed outside of the heat pipe. A semipermeable membrane 8 is also provided at the top of the heat pipe. If the carrier is a metal hydride, the wall 9, aside from being nonmagnetic must also be resistant to hydrogen.

To carry out the process according to the invention, the carrier molding (4) is displaced by means of the magnet (7) either into the region of the heat source or the heat sink. As the carrier is immersed into the heat source, it is flushed round about by the low-boiling liquid and is able to absorb heat relatively rapidly. If the carrier is present in the region of the heat sink, the gas to be reacted such as, for example, hydrogen is able in the case of a hydride to penetrate through the membrane (8) into the metal hydride core, in which case the central bore (5) enlarges substantially the surface area for the absorption of the hydrogen gas.

Figure 2:
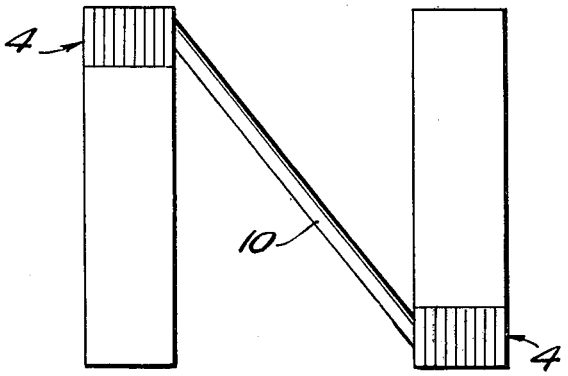
FIG. 2 is a schematic representation of a second embodiment of the apparatus of the present invention.

FIG. 2 shows in a most simple manner an embodiment where two heat pipes with the carrier (4) of the reversible, heterogeneous evaporation process are interconnected in the interior of the heat pipe in such a manner that the two carriers are interconnected through a gas pipe (10) and a pump (not shown) so that both heat pipes can be turned together through 180 degrees in such a manner that respectively the carrier (4) in one heat pipe is present at the top and the carrier (4) in the other heat pipe is present at the bottom.

Figure 3:
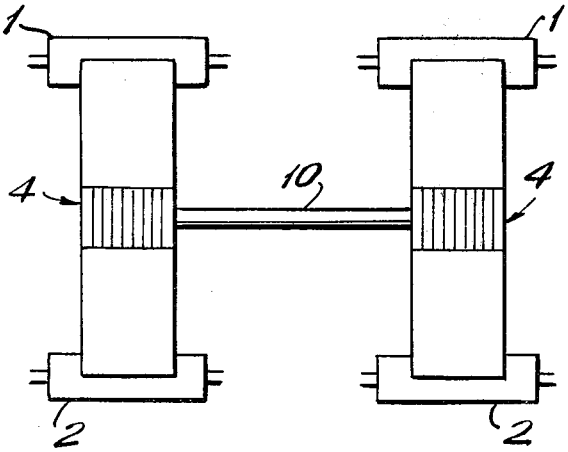
FIG. 3 is a schematic representation of a third embodiment of the apparatus of the present invention.

FIG. 3 shows diagrammagically two pairs of superposed heat pipes which are separated by the carrier (4) of the reversible, heterogeneous evaporation process. The two carriers are interconnected through a gap pipe (10) and a pump (not shown in the drawing). Moreover, each lower end of the two lower heat pipes is arranged in a heat source (2) and the upper part of the two upper heat pipes is arranged in a heat sink (1).

Figure 4:
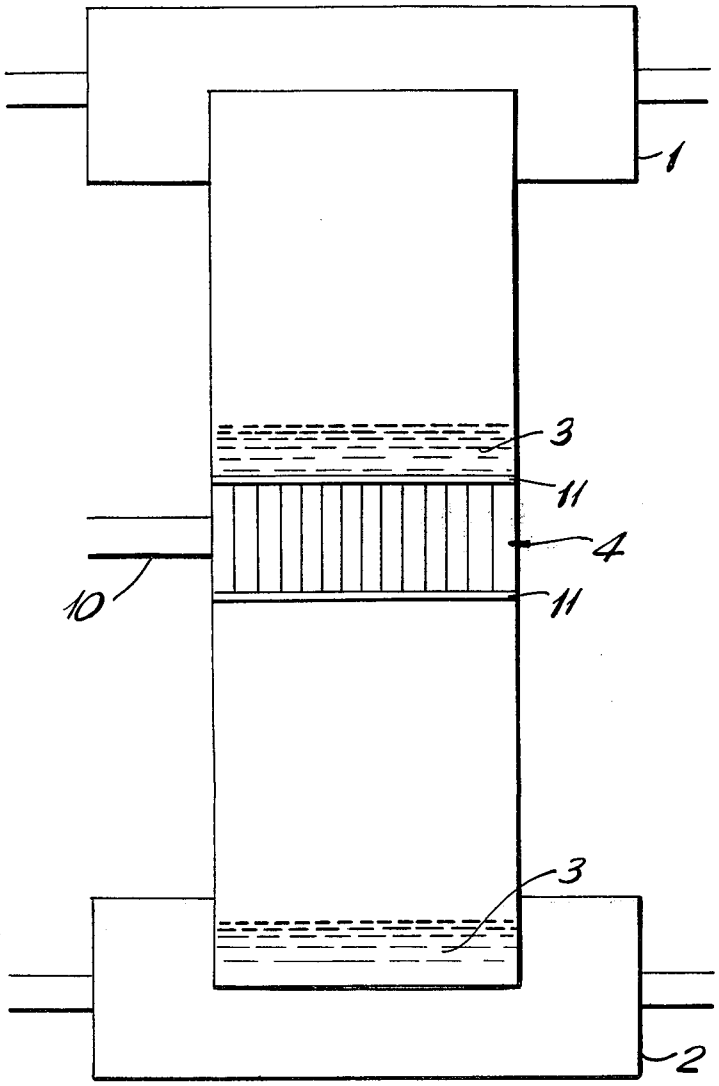
FIG. 4 shows a detail of one heat pipe of FIG. 3.

FIG. 4 shows in somewhat greater detail one of the pairs of superposed heat pipes. In this drawing, (11) represents the jacket which is impermeable to the readily vaporizable solvent and its vapor.

Figure 5:
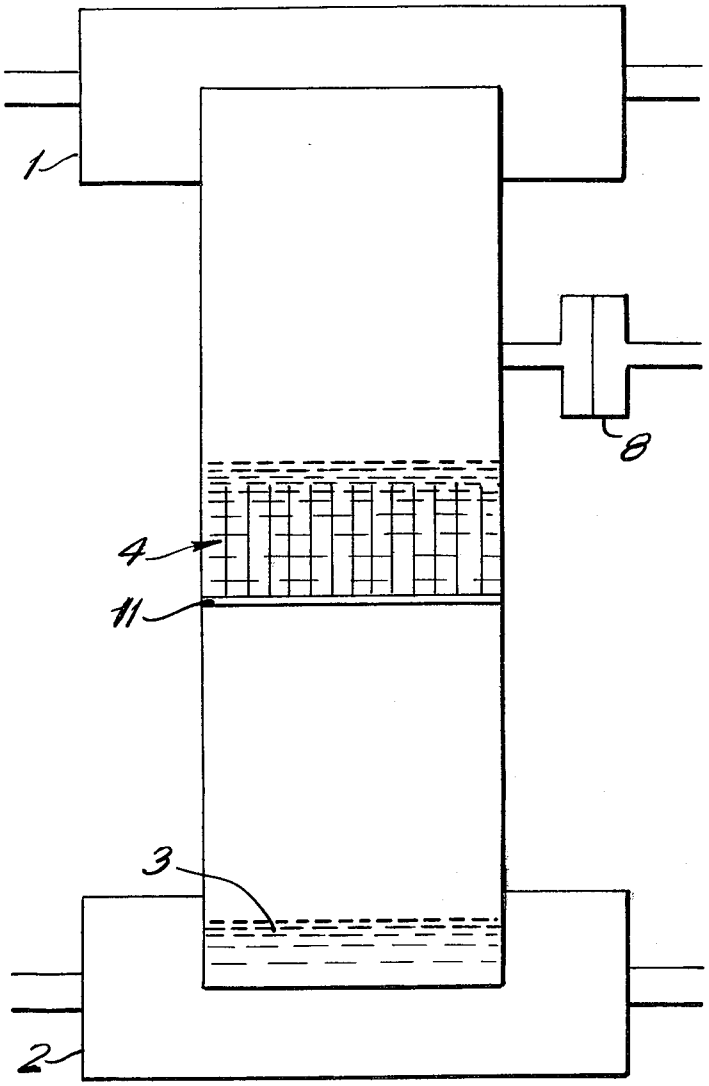
FIG. 5 is a schematic representation of a fourth embodiment of the apparatus of the present invention.

FIG. 5 shows an embodiment where the lower heat pipe is again separated from the carrier (4) by a jacket (11) which is impermeable for the readily vaporizable solvent (3) and its vapor. However, the upper heat pipe also contains the gas which is able to evaporate reversibly and heterogeneously from the carrier (4) in addition to a low-boiling liquid and its vapor. The vapor of the low-boiling solvent and the gas which is able to evaporate reversibly from the carrier are separated from each other at the pressure-proof semipermeable membrane (8).

Figure 6:
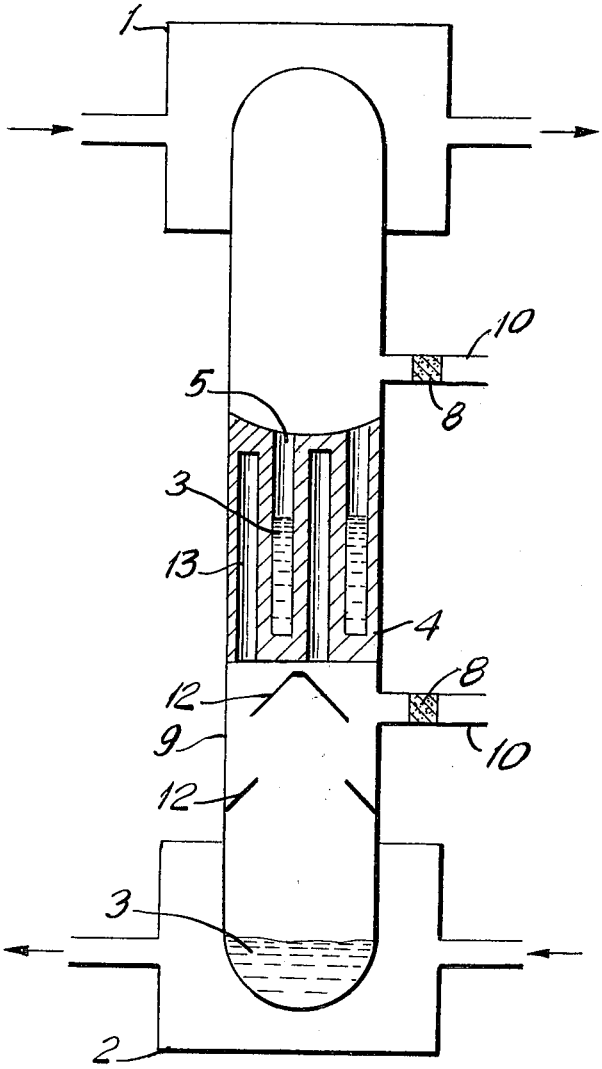
FIG. 6 is a schematic representation of a fifth embodiment of the apparatus of the present invention.

FIG. 6 shows an embodiment where the lower heat pipe is provided with baffle plates (12) at which the condensate passes by gravity to the inside wall of the reaction vessel (9) and evaporates again in the region of the heat source (2). On the one hand, the carrier (4) is provided with central bores (5) in which the low-boiling liquid of the upper heat pipe is able to accumulate. Moreover, it is provided with channels (13) in which the condensation of the vapor of the lower heat pipe takes place with heat emission. A cycle comprising absorption and desorption is described hereinafter in greater detail with reference to a metal hydride carrier as an example.

In the first phase, the storage of hydrogen, the hydrogen flows due to external superpressure through the hydrogen connection pipes (10) and the membranes (8) into the reaction vessel (9). The heat which is liberated by the reaction of hydrogen storage causes an increase in temperature of the carrier consisting of metal hydride (4) to a temperature which is above the temperature of the heat sink (1). The liquid (3) in the bores (5) evaporates and is condensed again in the region of the heat sink (1). Thus, a heat transport from the metal hydride (4) to the heat sink (1) takes place. In the second phase, the expulsion of hydrogen, the hydrogen flows due to the internal superpressure through the membranes (8) out of the reaction vessel (9). The reaction which takes place as the hydrogen is liberated from the hydride requires heat and causes cooling of the metal hydride (4) to a temperature lying below the temperature of the heat source (2). The vapor of the low-boiling liquid (3) present in the reaction vessel (9) beneath the metal hydride condenses with emission of heat at the surface of the condensation channels (13) of the metal hydride (4). The condensate passes by gravity over the baffle plate (12) to the inside wall of the reaction vessel (9) and evaporates again in the region of the heat source (2). Thus, transport of heat takes place from the heat source (2) to the metal hydride (4).

Figure 7:
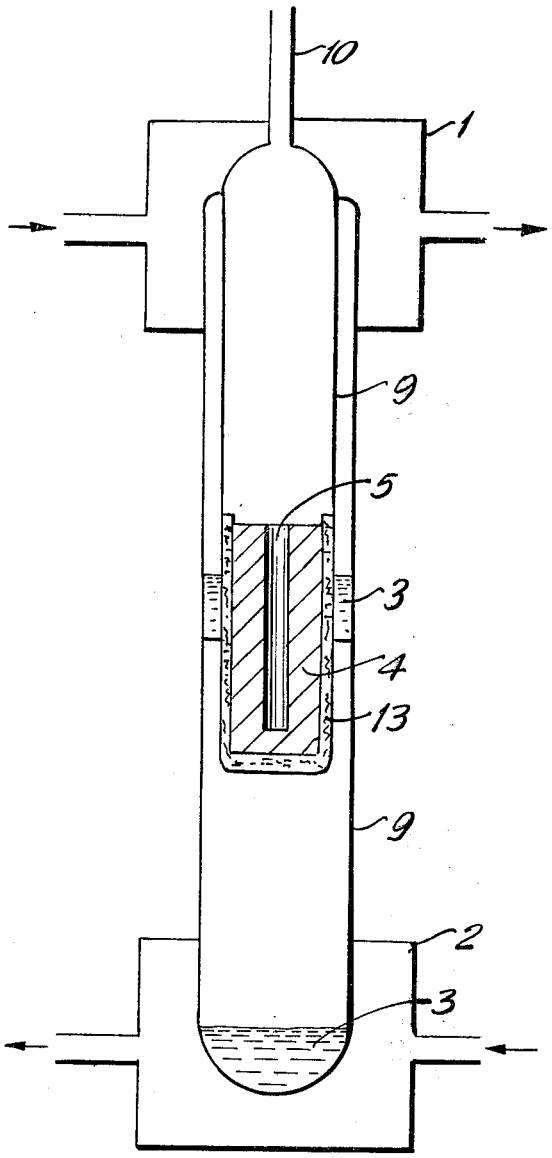
FIG. 7 is a schematic representation of a sixth embodiment of the apparatus of the present invention.

FIG. 7 shows a further embodiment wherein the carrier (4) is immersed in a liquid having high thermal conductivity such as, for example, mercury. Thereby, good heat exchange takes again place in and on the carrier. In case of this embodiment, the carrier is again immersed into an upper and a lower heat pipe, and the two heat pipes are separated from each other predominantly by the carrier.

What is claimed is:

1. In a process for the heat transfer from carriers of reversible, heterogeneous evaporation processes for the purpose of generating heat or cold by means of the principle of the heat pipe, the improvement comprising optimizing the heat transfer by arranging the carrier of the reversible, heterogeneous evaporation process in the interior of a heat pipe.

2. The process according to claim 1, comprising arranging two heat pipes in superposition and separating the heterogeneous evaporation process.

3. The process according to claim 1, comprising controlling the position of the carrier of the reversible, heterogeneous evaporation process within the heat pipe from outside the heat pipe.

4. The process according to claim 1, comprising providing two vertical heat pipes each having the carrier of the reversible, heterogeneous evaporation process in the interior thereof and at one end thereof and interconnecting the two pipes by a gas pipe and pump to interconnect the two carriers such that both heat pipes are able to be turned together through 180 degrees whereby a carrier is present at the top in one heat pipe and is present at the bottom in the other heat pipe.

5. The process according to claim 1, wherein the carrier of the reversible, heterogeneous evaporation process, the particular gas used and the liquid and vapor of the particular low-boiling liquid used are compatible with one another.

6. The process according to claim 5, further comprising separating the gas reversibly evaporating on the carrier from the vapor of the low-boiling liquid by a pressure-tight, semipermeable membrane.

7. The process according to claim 1, further comprises separating the carrier of the reversible, heterogeneous evaporation process from evaporating liquid by a jacket which is impermeable at least for the evaporating liquid and its vapor.

8. The process according to claim 2, further comprising filling the heat pipe above the carrier and the heat pipe below the carrier with two different evaporating liquids.

9. The process according to claim 1, further comprising geometrically configuring the carrier material to form as large a contact surface as is possible for the low-boiling liquid.

10. A heat transfer apparatus comprising a vertical heat pipe, a heat source connected to the bottom of the heat pipe a heat sink connected to the top of heat pipe and a low-boiling liquid and a carrier of a reversible, heterogeneous evaporation process in the heat pipe and a feed line and discharge line for the gas of the reversible heterogeneous evaporation process.

11. The apparatus according to claim 10, wherein the carrier of the reversible heterogeneous evaporation process contains an iron core and further comprising magnetic means disposed outside of the heat pipe for displacing the carrier within the heat pipe.

12. The apparatus according to claim 10, wherein the heat pipe comprises an upper portion and a lower portion separated by the carrier of the reversible heterogeneous evaporation process.

13. The apparatus according to claim 10, further comprising a pressure-resistant semipermeable membrane for separating the gas of the reversible heterogeneous evaporation process from the vapor of the low-boiling liquid.

14. The apparatus according to claim 10, further comprising a jacket for separating the carrier of the reversible, heterogeneous evaporation process from the low-boiling liquid and its vapor.

* * * * *